US007367790B2

(12) United States Patent
Hwang et al.

(10) Patent No.: US 7,367,790 B2
(45) Date of Patent: May 6, 2008

(54) DOUBLE-ACTING TYPE ORBITING VANE COMPRESSOR

(75) Inventors: Seon-woong Hwang, Anyang-Si (KR); Dong-won Yoo, Seoul (KR)

(73) Assignee: LG Electronics Inc., Seoul (KR)

( * ) Notice: Subject to any disclaimer, the term of this patent is extended or adjusted under 35 U.S.C. 154(b) by 57 days.

(21) Appl. No.: 11/111,849

(22) Filed: Apr. 22, 2005

(65) Prior Publication Data

US 2006/0073055 A1 Apr. 6, 2006

(30) Foreign Application Priority Data

Oct. 6, 2004 (KR) ..... 10-2004-0079630

(51) Int. Cl.
*F04C 18/04* (2006.01)

(52) U.S. Cl. ..... 418/59; 418/61.1

(58) Field of Classification Search ..... 418/59, 418/54, 60, 61.1

See application file for complete search history.

(56) References Cited

U.S. PATENT DOCUMENTS 2,758,546 A * 8/1956 Gillette ..... 418/60
2,966,898 A * 1/1961 Rydberg et al. ..... 123/247
3,125,031 A * 3/1964 Rydberg et al. ..... 418/59
3,782,865 A * 1/1974 Braun ..... 418/59
4,650,405 A * 3/1987 Iwanami et al. ..... 418/5
4,726,739 A * 2/1988 Saitou et al. ..... 417/286
4,990,073 A * 2/1991 Kudo et al. ..... 418/60
5,102,317 A * 4/1992 Okoma et al. ..... 418/60
5,314,318 A * 5/1994 Hata et al. ..... 418/60
6,171,076 B1 * 1/2001 Gannaway ..... 417/350
6,231,319 B1 * 5/2001 Iida et al. ..... 417/462
6,280,168 B1 * 8/2001 Matsumoto et al. ..... 418/151
6,796,773 B1 * 9/2004 Choi et al. ..... 417/218

FOREIGN PATENT DOCUMENTS

KR 20-19960031881 10/1996
KR 10-20040007984 1/2004

* cited by examiner

*Primary Examiner*—Thomas Denion
*Assistant Examiner*—Mary A Davis
(74) *Attorney, Agent, or Firm*—Greenblum & Bernstein, P.L.C.

(57) ABSTRACT

The double-acting type orbiting vane compressor comprises an orbiting vane having upper and lower circular vanes formed at the upper and lower surfaces of a vane plate of the orbiting vane, respectively, the orbiting vane being attached to a crankshaft rotatable by a drive unit, an upper compression unit having the upper circular vane of the orbiting vane disposed in an upper cylinder, and a lower compression unit having the lower circular vane of the orbiting vane disposed in a lower cylinder. As the orbiting vane performs an orbiting movement in the upper and lower cylinders, refrigerant gases introduced into the upper and lower cylinders through inlet tubes respectively formed at the upper and lower cylinders are compressed, and are then discharged out of the upper and lower cylinders through outlet ports respectively formed at the upper and lower cylinders.

9 Claims, 6 Drawing Sheets

DOUBLE-ACTING TYPE ORBITING VANE COMPRESSOR

CROSS-REFERENCE TO RELATED APPLICATIONS

This application claims foreign priority under 35 U.S.C. § 119(a)-(d) to Korean Patent Application No. 10-2004-0079630 filed on 6 Oct. 2004.

BACKGROUND OF THE INVENTION

1. Field of the Invention

The present invention relates to an orbiting vane compressor, and, more particularly, to a double-acting type orbiting vane compressor having increased compression capacity.

2. Description of the Related Art

Referring to FIG. 1, there is illustrated a conventional orbiting vane compressor. As shown in FIG. 1, a drive unit D and a compression unit P are mounted in a shell 1 while the drive unit D and the compression unit P are hermetically sealed. The drive unit D and the compression unit P are connected to each other via a vertical crankshaft 8, the upper and lower ends of which are rotatably supported by a main frame 6 and a subsidiary frame 7, such that power from the drive unit D is transmitted to the compression unit P through the crankshaft 8.

The drive unit D comprises: a stator 2 fixedly disposed between the main frame 6 and the subsidiary frame 7; and a rotor 3 disposed in the stator 2 for rotating the crankshaft 8, which vertically extends through the rotor 3, when electric current is supplied to the rotor 3. The rotor 3 is provided at the top and bottom parts thereof with balance weights 3*a*, which are disposed symmetrically to each other for preventing the crankshaft 8 from being rotated in an unbalanced state due to a crank pin 81.

The compression unit P comprises an orbiting vane 5 having a boss 55 formed at the lower part thereof. The crank pin 81 is fixedly fitted in the boss 55 of the orbiting vane 5. As the orbiting vane 5 performs an orbiting movement in a cylinder 4, refrigerant gas introduced into the cylinder 4 through an inlet tube 11 is compressed. The cylinder 4 comprises an inner ring 41 integrally formed at the upper part thereof while being protruded downward. The orbiting vane 5 comprises a circular vane 51 formed at the upper part thereof while being protruded upward. The circular vane 51 performs an orbiting movement in an annular space 42 defined between the inner ring 41 and the inner wall of the cylinder 4. Through the orbiting movement of the circular vane 51, inner and outer compression chambers are formed at the inside and the outside of the circular vane 51, respectively. Refrigerant gases compressed in the inner and outer compression chambers are discharged out of the cylinder 4 through inner and outer outlet ports 44 and 44*a* formed at the upper part of the cylinder 4, respectively.

Between the main frame 6 and the orbiting vane 5 is disposed an Oldham's ring 9 for preventing rotation of the orbiting vane 5. Through the crankshaft 8 is longitudinally formed an oil supplying channel 82 for allowing oil to be supplied to the compression unit P therethrough when an oil pump 83 mounted at the lower end of the crankshaft 8 is operated.

Unexplained reference numeral 11 indicates an inlet tube, 12 a high-pressure chamber, and 13 an outlet tube.

FIG. 2 is an exploded perspective view illustrating the structure of the compression unit P shown in FIG. 1.

In the compression unit P of the orbiting vane compressor, as shown in FIG. 2, the orbiting vane 5, which is connected to the crankshaft 8, is disposed on the upper end of the main frame 6, which rotatably supports the upper part of the crankshaft 8. The cylinder 4, which is attached to the main frame 6, is disposed above the orbiting vane 5. The cylinder 4 is provided at a predetermined position of the circumferential part thereof with an inlet port 43. The inner and outer outlet ports 44 and 44*a* are formed at predetermined positions of the upper end of the cylinder 4.

The crank pin 81 of the crankshaft 8 is fixedly fitted in the boss 55, which is formed at the lower surface of a vane plate 50 of the orbiting vane 5. At a predetermined position of the circumferential part of the circular vane 51 of the orbiting vane 5 is formed a through-hole 52 for allowing refrigerant gas introduced through the inlet port 43 of the cylinder 4 to be guided into the circular vane 51 therethrough. At another predetermined position of the circumferential part of the circular vane 51 of the orbiting vane 5, which is adjacent to the position where the through-hole 52 is disposed, is formed an opening 53. A slider 54 is slidably disposed in the opening 53.

FIG. 3 is a cross-sectional view illustrating the operation of the conventional orbiting vane compressor shown in FIG. 1.

When the orbiting vane 5 of the compression unit P is driven by power transmitted to the compression unit P from the drive unit D through the crankshaft 8 (See FIG. 1), the circular vane 51 of the orbiting vane 5 disposed in the annular space 42 of the cylinder 4 performs an orbiting movement in the annular space 42 of the cylinder 4, as indicated by arrows, to compress refrigerant gas introduced into the annular space 42 through the inlet port 43.

At the initial orbiting position of the orbiting vane 5 of the compression unit P (i.e., the 0-degree orbiting position), refrigerant gas is introduced into an inner suction chamber A1 through the inlet port 43 and the through-hole 52 of the circular vane 51, and compression is performed in an outer compression chamber B2 of the circular vane 51 while the outer compression chamber B2 does not communicate with the inlet port 43 and the outer outlet port 44*a*. Refrigerant gas is compressed in an inner compression chamber A2, and at the same time, the compressed refrigerant gas is discharged out of the inner compression chamber A2 through the inner outlet port 44.

At the 90-degree orbiting position of the orbiting vane 5 of the compression unit P, the compression is still performed in the outer compression chamber B2 of the circular vane 51, and almost all the compressed refrigerant gas is discharged out of the inner compression chamber A2 through the inner outlet port 44. At this stage, an outer suction chamber B1 appears so that refrigerant gas is introduced into the outer suction chamber B1 through the inlet port 43.

At the 180-degree orbiting position of the orbiting vane 5 of the compression unit P, the inner suction chamber A1 disappears. Specifically, the inner suction chamber A1 is changed into the inner compression chamber A2, and therefore, compression is performed in the inner compression chamber A2. At this stage, the outer compression chamber B2 communicates with the outer outlet port 44*a*. Consequently, compressed refrigerant gas is discharged out of the outer compression chamber B2 through the outer outlet port 44*a*.

At the 270-degree orbiting position of the orbiting vane 5 of the compression unit P, almost all the compressed refrigerant gas is discharged out of the outer compression chamber B2 of the circular vane 51 through the outer outlet port 44*a*, and the compression is still performed in the inner compression chamber A2 of the circular vane 51. Also, compression is newly performed in the outer suction chamber B1. When the orbiting vane 5 of the compression unit P further performs the orbiting movement by 90 degrees, the outer suction chamber B1 disappears. Specifically, the outer suction chamber B1 is changed into the outer compression chamber B2, and therefore, the compression is continuously performed in the outer compression chamber B2. As a result, the orbiting vane 5 of the compression unit P is returned to the position where the orbiting movement of the orbiting vane 5 is initiated. In this way, a 360-degree-per-cycle orbiting movement of the orbiting vane 5 of the compression unit P is accomplished. The orbiting movement of the orbiting vane 5 of the compression unit P is repeatedly performed in succession.

The slider 54 is slidably disposed in the opening 53 for maintaining the seal between the inner and outer compression chambers A2 and B2 of the circular vane 51.

In the conventional orbiting vane compressor as described above, however, the volume of the inner and outer compression chambers must be increased in order to increase compression capacity of the compression unit. The volume of the inner and outer compression chambers may be increased by increasing the height of the orbiting vane or increasing the size of the annular space of the cylinder, which increases the size of the orbiting vane compressor.

SUMMARY OF THE INVENTION

Therefore, the present invention has been made in view of the above problems, and it is an object of the present invention to provide a double-acting type orbiting vane compressor comprising a pair of compression units having circular vanes formed at the upper and lower parts of an orbiting vane, respectively, whereby compression capacity of the compressor is increased without changing the size of the compressor.

It is another object of the present invention to provide a double-acting type orbiting vane compressor having a low-pressure structure in which introduced gas is filled in a shell.

It is another object of the present invention to provide a double-acting type orbiting vane compressor having a high-pressure structure in which discharged gas is filled in a shell.

It is yet another object of the present invention to provide a double-acting type orbiting vane compressor that is capable of guiding gases discharged from a pair of compression units to an outlet tube in a simple structure.

In accordance with the present invention, the above and other objects can be accomplished by the provision of a double-acting type orbiting vane compressor comprising: a shell having at least one inlet tube and an outlet tube, the shell being hermetically sealed such that refrigerant gas is introduced through the inlet tube and is then discharged through the outlet tube; a crankshaft disposed in the shell such that the crankshaft can be rotated by a drive unit; and upper and lower compression units provided at the upper and lower parts of an orbiting vane, which is connected to the crankshaft, respectively.

Preferably, the orbiting vane comprises: circular vanes formed at the upper and lower surfaces of a vane plate, respectively.

Preferably, the orbiting vane further comprises: a boss formed in the circular vane formed at the lower surface of the vane plate such that the crankshaft is fitted in the boss.

Preferably, the crankshaft has an oil supplying channel formed longitudinally therethrough.

Preferably, each of the circular vanes is provided at a predetermined position of the circumferential part thereof with an opening, and the orbiting vane further comprises: sliders disposed in the openings, respectively.

Preferably, each of the circular vanes is provided at another predetermined position of the circumferential part thereof, adjacent to the position where the corresponding slider is disposed, with a through-hole for allowing refrigerant gas to be introduced into the corresponding circular vane therethrough.

Preferably, the upper compression unit compresses refrigerant gas according to an orbiting movement of the upper circular vane of the orbiting vane in an annular space defined in an upper cylinder, and the lower compression unit compresses refrigerant gas according to an orbiting movement of the lower circular vane of the orbiting vane in an annular space defined in a lower cylinder.

Preferably, the annular spaces are defined between inner rings disposed in the upper and lower cylinders and the inner walls of the upper and lower cylinders, respectively.

Preferably, the at least one inlet tube comprises a single inlet tube penetrating the shell such that refrigerant gas is introduced into the respective upper and lower cylinders through the single inlet tube, is guided into the upper and lower compression units through inlet ports formed at the respective upper and lower cylinders, where the refrigerant gas is compressed, and is then discharged out of the upper and lower compression units through outlet ports formed at the respective upper and lower cylinders.

Preferably, the at least one inlet tube comprises a pair of inlet tubes penetrating the shell while being air-tightly connected to the inlet tubes, respectively, such that refrigerant gases are introduced into the respective upper and lower cylinders through the pair of inlet tubes, are guided into the upper and lower compression units through inlet ports formed at the respective upper and lower cylinders, where the refrigerant gases are compressed, and are then discharged out of the upper and lower compression units through outlet ports formed at the respective upper and lower cylinders.

Preferably, the inlet ports are formed at predetermined positions of the circumferential parts of the upper and lower cylinders, respectively.

Preferably, the outlet ports are formed at the upper surface of the upper cylinder and the lower surface of the lower cylinder, respectively.

Preferably, each of the outlet ports comprises: inner and outer outlet ports communicating with inner and outer compression chambers divided by the corresponding circular vane disposed in each of the upper and lower cylinders.

Preferably, the double-acting type orbiting vane compressor further comprises: a high and low pressure separating plate disposed between the outer circumferential part of the upper cylinder and the inner circumferential part of the shell; a lower separating plate attached to the lower surface of the lower cylinder such that the lower separating plate surrounds the outlet ports of the lower cylinder; and a guide channel for guiding high-pressure refrigerant gases discharged through the outlet ports of the lower cylinder to the outlet tube.

Preferably, the guide channel comprises: a through-pipe extending upward from the lower separating plate through the lower cylinder, the upper cylinder, and the high and low pressure separating plate.

Preferably, the guide channel comprises: an external guide pipe having one end penetrating the shell from the outside of the shell such that the external guide pipe is inserted between the lower separating plate and the lower surface of the lower cylinder and the other end penetrating a predetermined position of the upper circumferential part of the shell.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the accompanying drawings.

Figure 1:
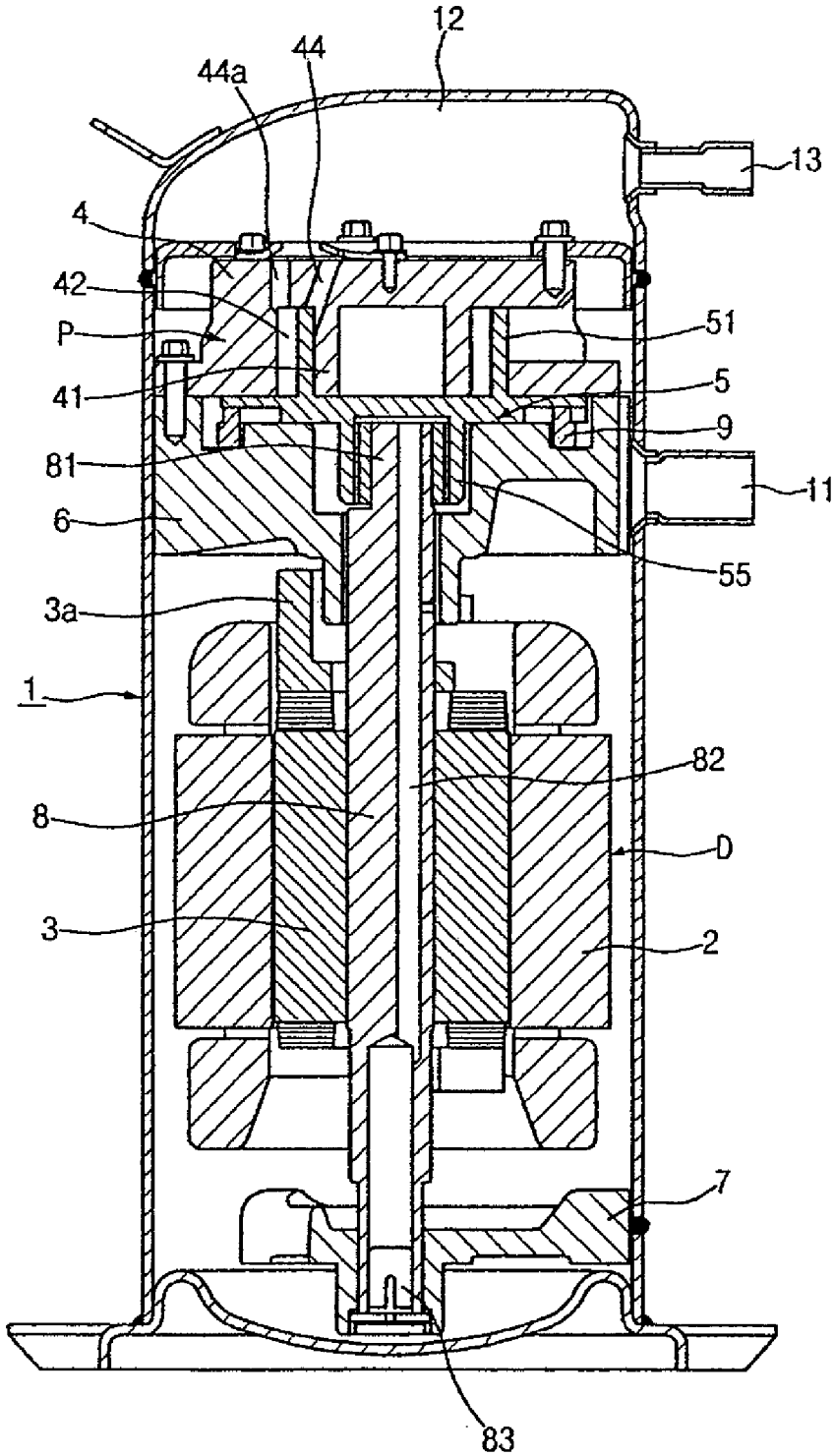
FIG. 1 is a longitudinal sectional view illustrating the overall structure of a conventional orbiting vane compressor.
Figure 2:
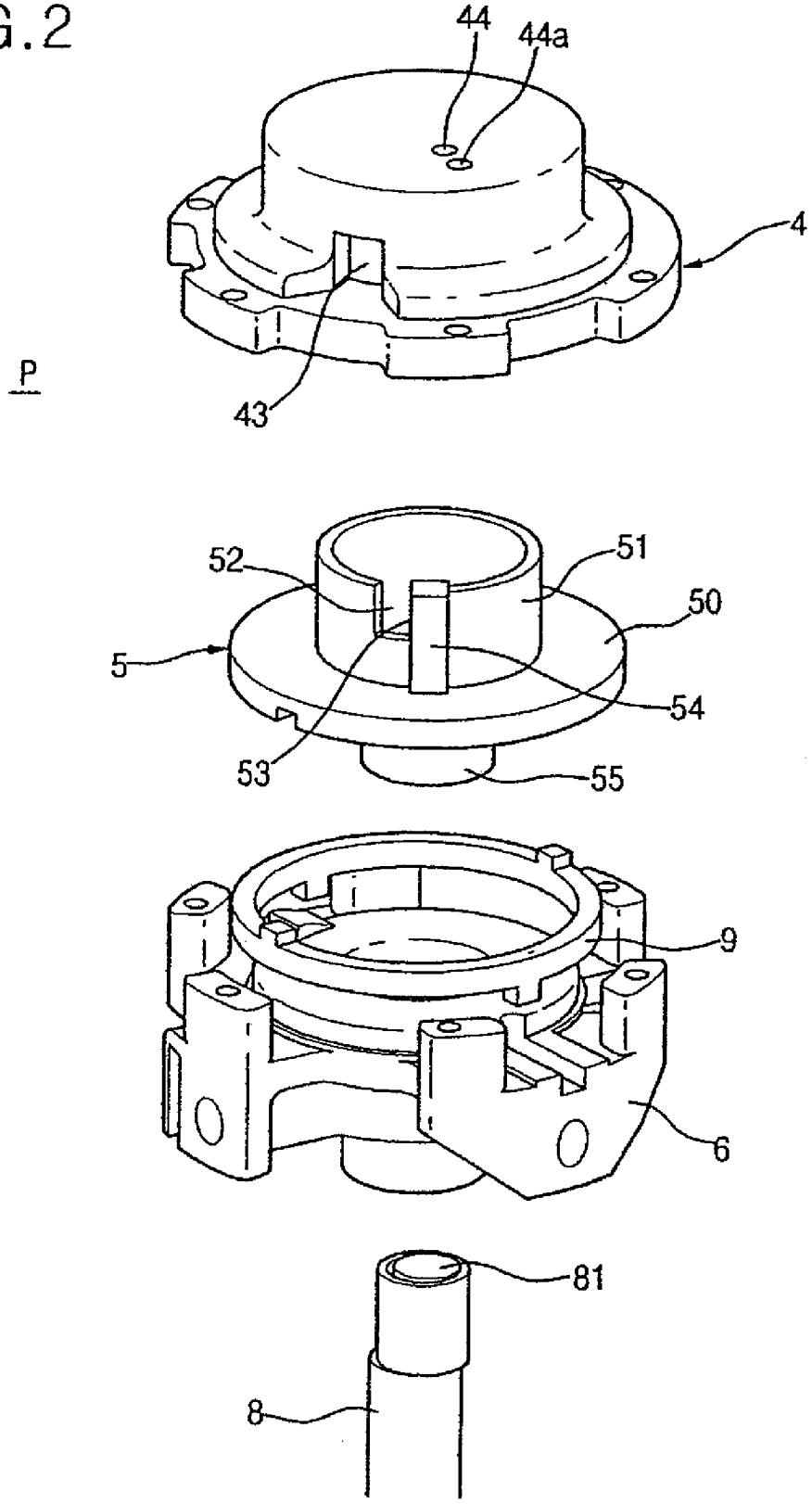
FIG. 2 is an exploded perspective view illustrating the structure of a compression unit of the conventional orbiting vane compressor shown in FIG. 1.
Figure 3:
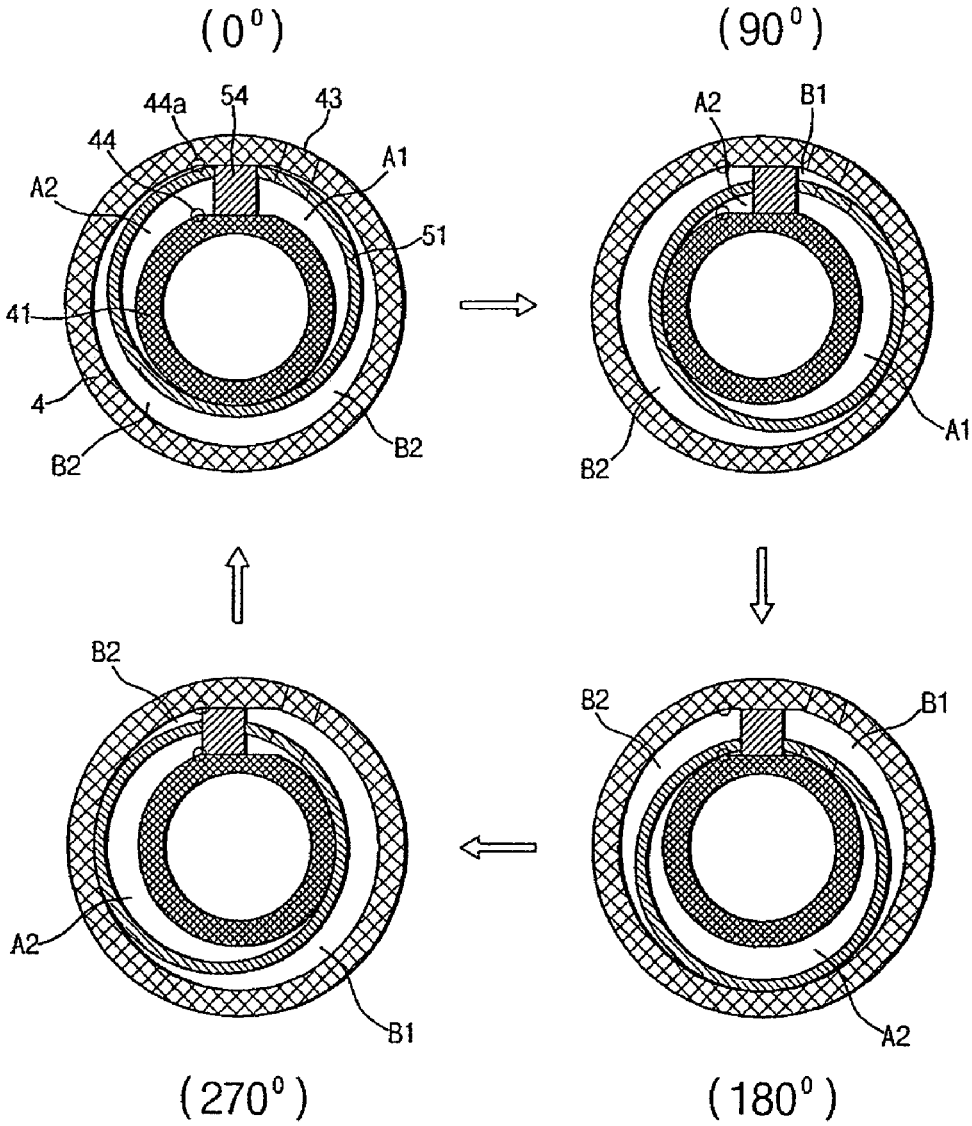
FIG. 3 is a cross-sectional view illustrating the operation of the conventional orbiting vane compressor shown in FIG. 1.
Figure 4:
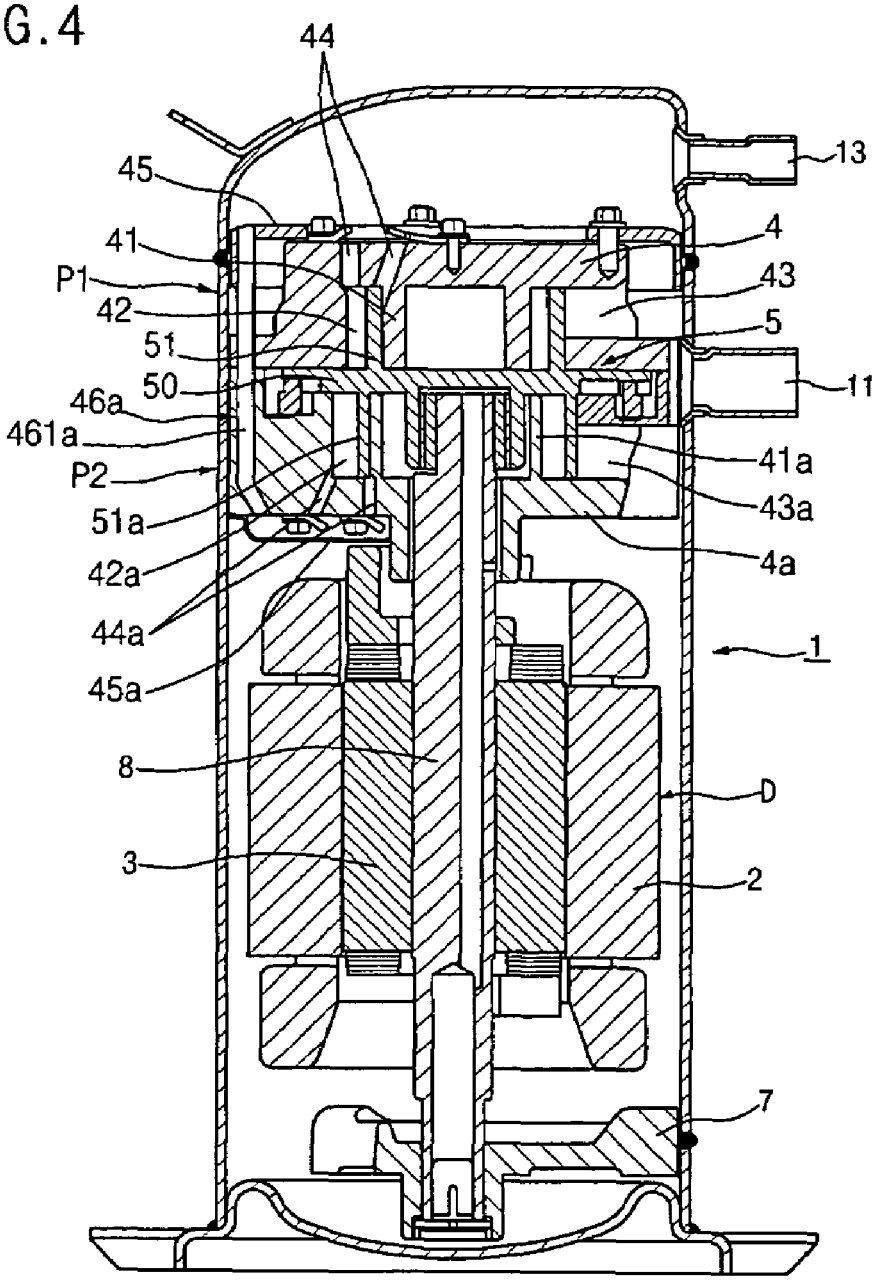
FIG. 4 is a longitudinal sectional view illustrating a double-acting type orbiting vane compressor according to a first preferred embodiment of the present invention.

FIG. 4 is a longitudinal sectional view illustrating a double-acting type orbiting vane compressor according to a first preferred embodiment of the present invention.

As shown in FIG. 4, the double-acting type orbiting vane compressor comprises: an inlet tube 11 and an outlet tube 13 disposed at predetermined positions of the upper circumferential part of a hermetically sealed shell 1, respectively, while the outlet tube 13 is disposed above the inlet tube 11; a drive unit D disposed in the shell 1 for rotating a crankshaft 8, which is also disposed in the shell 1; and an upper compression unit P1 and a lower compression unit P2 for compressing refrigerant gases introduced into cylinders, respectively, as the crankshaft 8 is rotated by the drive unit D.

The lower end of the crankshaft 8 is rotatably supported by a subsidiary frame 7, and the upper end of the crankshaft 8 is rotatably supported by a lower cylinder 4*a* of the lower compression unit P2. The drive unit D is disposed between the subsidiary frame 7 and the lower cylinder 4*a*. The drive unit D comprises a stator 2 and a rotor 3, by which the crankshaft 8 is rotated.

On the lower cylinder 4*a*, by which the crankshaft 8 is supported, is disposed an upper cylinder 4. Between the lower cylinder 4*a* and the upper cylinder 4 is disposed an orbiting vane 5, which is eccentrically attached to the upper end of the crankshaft 8. In this way, the upper compression unit P1 and the lower compression unit P2 are constructed.

The upper cylinder 4 of the upper compression unit P1 is provided at a predetermined position of the circumferential part thereof with an inlet port 43. In the upper cylinder 4 is disposed an upper inner ring 41, which extends downward from the upper part of the upper cylinder 4. Between the upper inner ring 41 and the inner circumferential surface of the upper cylinder 4 is defined an upper annular space 42. In the upper annular space 42 is disposed an upper circular vane 51, which is formed at the upper surface of a vane plate 50 of the orbiting vane 5.

As the crankshaft 8 is rotated, the upper circular vane 51 of the orbiting vane 5 performs an orbiting movement in the upper annular space 42. As a result, refrigerant gas introduced into the upper annular space 42 of the upper cylinder 4 from the inlet tube 11 through the inlet port 43 is compressed and then discharged upward through a pair of outlet ports 44.

The lower cylinder 4*a* of the lower compression unit P2 is provided at a predetermined position of the circumferential part thereof with an inlet port 43*a*. In the lower cylinder 4*a* is disposed a lower inner ring 41*a*, which extends upward from the lower part of the lower cylinder 4*a*. Between the lower inner ring 41*a* and the inner circumferential surface of the lower cylinder 4*a* is defined a lower annular space 42*a*. In the lower annular space 42*a* is disposed a lower circular vane 51*a*, which is formed at the lower surface of the vane plate 50 of the orbiting vane 5.

In the lower circular vane 51*a* is formed a boss 55, in which the upper end of the crankshaft 8 is fitted.

As the crankshaft 8 is rotated, the lower circular vane 51*a* of the orbiting vane 5 performs an orbiting movement in the lower annular space 42*a*. As a result, refrigerant gas introduced into the lower annular space 42*a* of the lower cylinder 4*a* from the inlet tube 11 through the inlet port 43*a* is compressed and then discharged downward through a pair of outlet ports 44*a*.

The upper compression unit P1 has inner and outer compression chambers formed in the upper annular space 42 of the upper cylinder 4 by the upper circular vane 51 formed at the upper part of the orbiting vane 5. Similarly, the lower compression unit P2 has inner and outer compression chambers formed in the lower annular space 42*a* of the lower cylinder 4*a* by the lower circular vane 51*a* formed at the lower part of the orbiting vane 5. In this way, two compression chambers are formed in the upper compression unit P1 and two compression chambers are formed in the lower compression unit P2. Consequently, the compression capacity of the orbiting vane compressor is considerably increased.

In the orbiting vane compressor according to the illustrated embodiment of the present invention, a high and low pressure separating plate 45 is disposed between the outer circumferential part of the upper cylinder 4 and the inner circumferential part of the shell 1. A lower separating plate 45*a* is attached to the lower surface of the lower cylinder 4*a* such that the lower separating plate 45*a* surrounds the outlet ports 44*a* of the lower cylinder 4*a*. High-pressure refrigerant gases discharged through the outlet ports 44*a* of the lower cylinder 4*a* are guided to the outlet tube 13 through a guide channel 46*a*. In this way, the shell 1 is constructed in a low-pressure structure.

The high and low pressure separating plate 45 is air-tightly disposed between the outer circumferential part of the upper cylinder 4 and the inner circumferential part of the shell 1 for separating low-pressure gas introduced through the inlet tube 11 from high-pressure gas discharged through the outlet part 44 of the upper cylinder 4.

The lower separating plate 45*a* is air-tightly attached to the lower surface of the lower cylinder 4*a* such that the lower separating plate 45*a* surrounds the outlet ports 44*a* of the lower cylinder 4*a* for separating the interior of the shell 1 communicating with the inlet tube 11 and thus filled with the introduced low-pressure gas from the high-pressure gases discharged through the outlet parts 44 of the upper cylinder 4.

The guide channel 46*a* serves to guide the high-pressure gas, discharged to above the lower separating plate 45*a* through the outlet ports 44*a* of the lower cylinder 4*a*, to the inner upper part of the shell 1 and then to the outlet tube 13. The guide channel 46*a* comprises a through-pipe 461*a* extending upward from the lower separating plate 45*a* through the lower cylinder 4*a*, the upper cylinder 4, and the high and low pressure separating plate 45.

The through-pipe 461*a* is disposed in the shell 1. Consequently, the through-pipe 461*a* is not damaged by any external force.

Low-temperature and low-pressure refrigerant gas introduced through the inlet tube 11 is filled in the shell 1, and is then introduced into the annular spaces 42 and 42*a* through the inlet ports 43 and 43*a* of the upper cylinder 4 and the lower cylinder 4*a*. The refrigerant gases introduced into the annular spaces 42 and 42*a* are compressed by the circular vanes 51 and 51*a*, and are then discharged through the outlet ports 44 and 44*a*, respectively. The high-temperature and high-pressure refrigerant gases discharged through the outlet ports 44 and 44*a*, respectively, are guided into the inner upper part of the shell 1, and are then discharged out of the shell 1 through the outlet tube 13.

As described above, the orbiting vane compressor has the low-pressure structure in which the refrigerant gas introduced through the inlet tube 11 is filled in the shell 1. Consequently, heat generated from the drive unit D is sufficiently cooled by the low-temperature refrigerant gas filled in the shell 1, and therefore, the orbiting vane compressor is stably operated.

Figure 5:
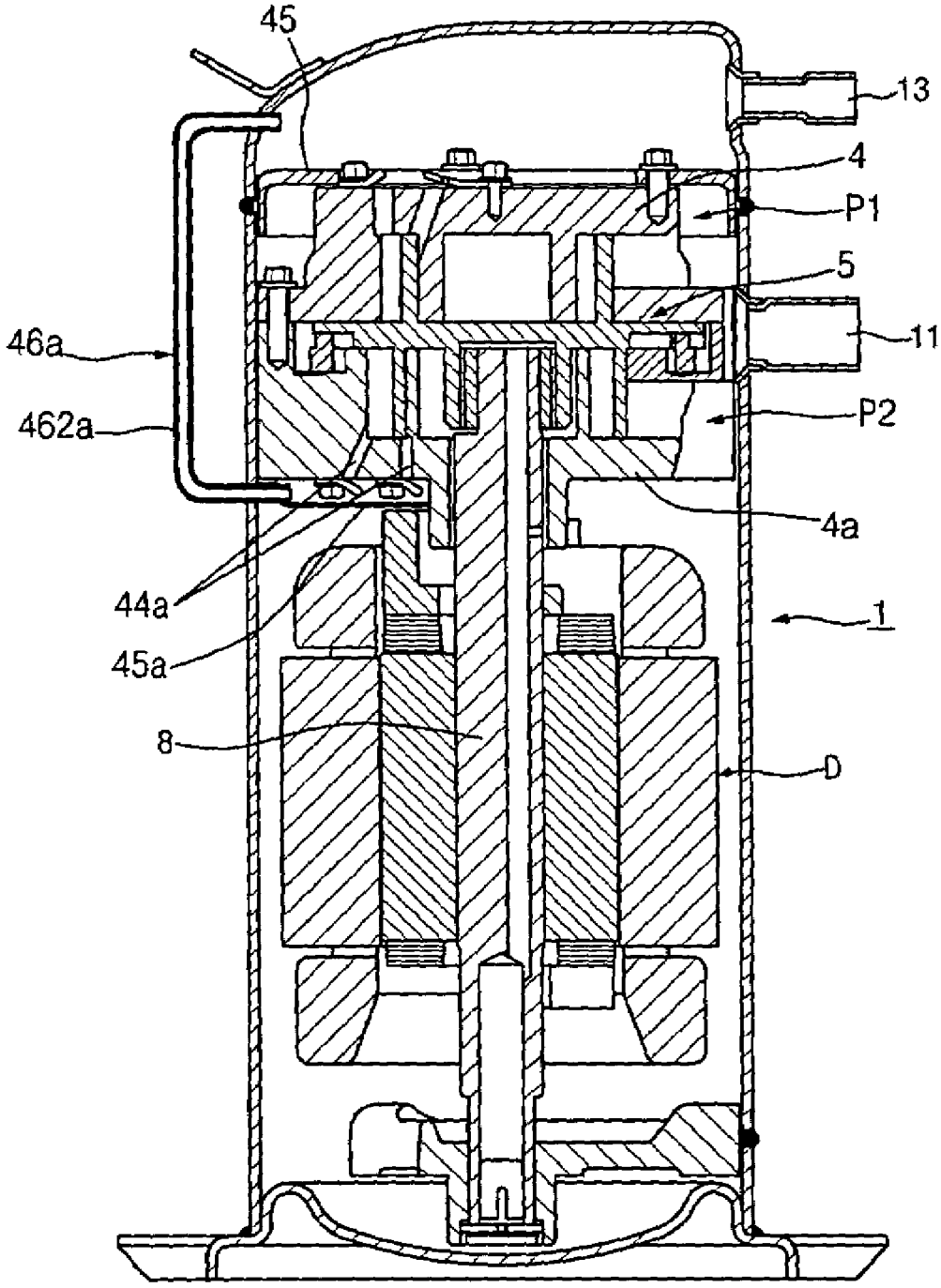
FIG. 5 is a longitudinal sectional view illustrating a double-acting type orbiting vane compressor according to a second preferred embodiment of the present invention.

FIG. 5 is a longitudinal sectional view illustrating a double-acting type orbiting vane compressor according to a second preferred embodiment of the present invention, As shown in FIG. 5, the double-acting type orbiting vane compressor comprises an upper compression unit P1 and a lower compression unit P2 disposed at the upper and lower parts of an orbiting vane 5. The orbiting vane 5 performs an orbiting movement as a crankshaft 8 is rotated by a drive unit D.

At the upper surface of an upper cylinder 4 constituting the upper compression unit P1 is disposed a high and low pressure separating plate 45, and at the lower surface of a lower cylinder 4*a* constituting the lower compression unit P2 is disposed a lower separating plate 45*a*. High-pressure gas discharged from the upper and lower cylinders is separated from low-pressure gas introduced into the upper and lower cylinders by the high and low pressure separating plate 45 and the lower separating plate 45*a*. Consequently, gas introduced through the inlet tube 11 is filled in the shell 1. In this way, the orbiting vane compressor has a low-pressure structure.

In the orbiting vane compressor according to the illustrated embodiment of the present invention, gases discharged toward the lower separating plate 45*a* through the outlet ports 44*a* of the lower cylinder 4*a* are guided into the inner upper part of the shell 1 through a guide channel 46*a*, and are then discharged out of the shell 1 through the outlet tube 13.

The guide channel 46*a* comprises an external guide pipe 462*a* having one end penetrating the shell 1 from the outside of the shell 1 such that the external guide pipe 462*a* is inserted between the lower separating plate 45*a* and the lower surface of the lower cylinder 4*a* and the other end penetrating a predetermined position of the upper circumferential part of the shell 1 to communicate with the interior of the shell 1.

As described above, the external guide pipe 462*a* is disposed outside the shell 1. Consequently, it is not necessary to form additional through-holes at the upper cylinder 4 and the lower cylinder 4*a*, respectively, and therefore, the orbiting vane compressor is very easily manufactured and installed.

Figure 6:
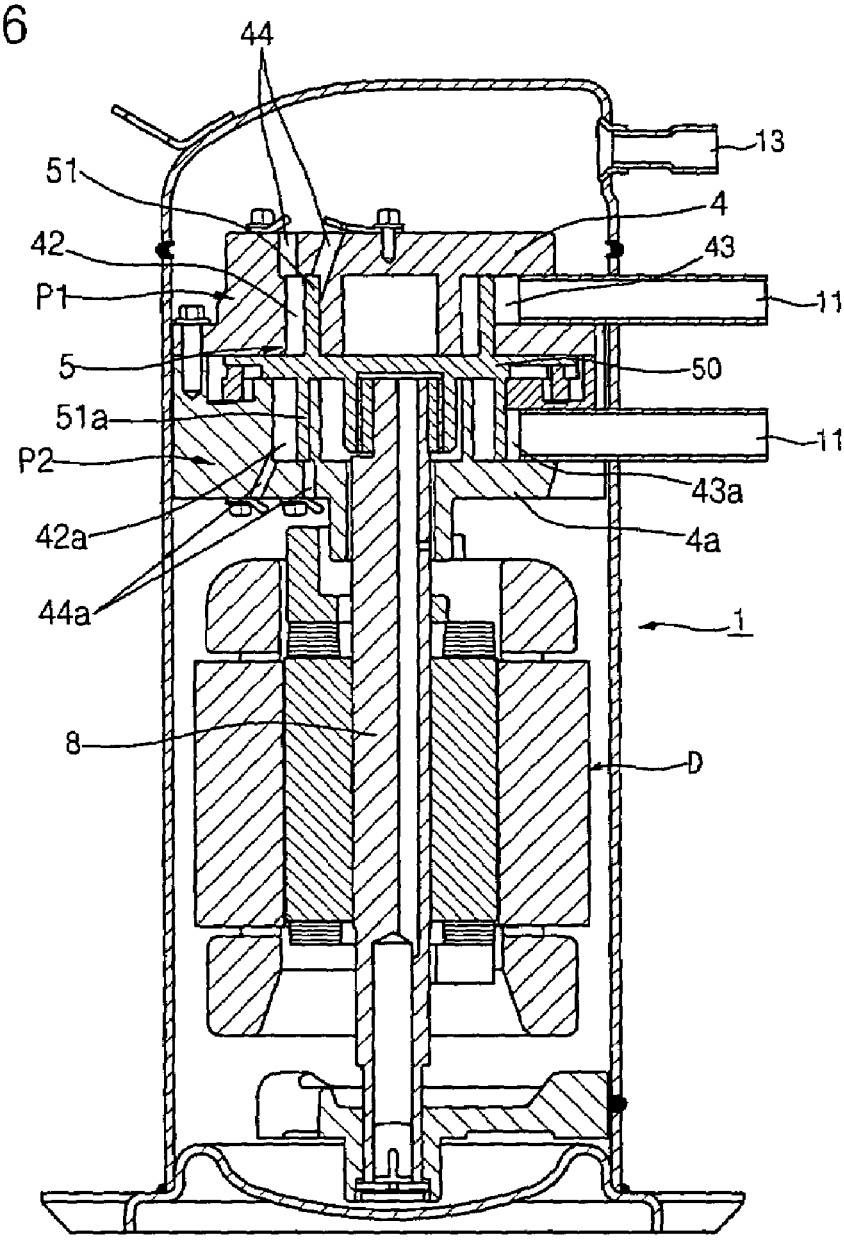
FIG. 6 is a longitudinal sectional view illustrating a double-acting type orbiting vane compressor according to a third preferred embodiment of the present invention.

FIG. 6 is a longitudinal sectional view illustrating a double-acting type orbiting vane compressor according to a third preferred embodiment of the present invention.

As shown in FIG. 6, the double-acting type orbiting vane compressor comprises: a hermetically sealed shell 1 having a pair of inlet tubes 11 and an outlet tube 13 disposed at predetermined positions of the upper circumferential part thereof, respectively, while the outlet tube 13 is disposed above the pair of inlet tubes 11; a drive unit D disposed in the shell 1 for rotating a crankshaft 8, which is also disposed in the shell 1; and an upper compression unit P1 and a lower compression unit P2 for compressing refrigerant gases introduced into cylinders, respectively, as the crankshaft 8 is rotated by the drive unit D.

The inlet tubes 11 are air-tightly connected to an inlet port 43 formed at an upper cylinder 4 and an inlet port 43*a* formed at a lower cylinder 4*a*, respectively. In this way, the shell 1 is constructed in a high-pressure structure.

In the orbiting vane compressor according to the illustrated embodiment of the present invention, gases introduced into annular spaces 42 and 42*a* defined in the upper and lower cylinders 4 and 4*a* through the inlet ports 43 and 43*a* of the upper and lower cylinders 4 and 4*a* from the respective inlet tubes 11 are compressed in the annular spaces 42 and 42*a* by circular vanes 51 and 51*a*, and are then discharged into the shell 1 through outlet ports 44 and 44*a*. As a result, the discharged high-pressure gas is filled in the shell 1, and is then discharged out of the shell 1 through the outlet tube 13.

As described above, refrigerant gases introduced through the inlet tube 11 are directly guided into the upper and lower cylinders 4 and 4*a* through the inlet ports 43 and 43*a*, respectively, and are then compressed in the upper and lower cylinders 4 and 4*a*. The compressed high-pressure refrigerant gases are filled in the shell 1, and are then discharged out of the shell 1. Consequently, refrigerant gas is prevented from being lost due to heat generated from the drive unit D when the refrigerant gas is introduced, and therefore, compression efficiency of the orbiting vane compressor is improved.

As apparent from the above description, the present invention provides a double-acting type orbiting vane compressor comprising a pair of compression units having circular vanes formed at the upper and lower parts of an orbiting vane, respectively. Consequently, the present invention has the effect of increasing the compression capacity of the compressor without changing the size of the compressor.

Also, the present invention provides a double-acting type orbiting vane compressor having a low-pressure structure in which introduced gas is filled in a shell. Consequently, the present invention has the effect of sufficiently cooling a drive unit of the orbiting vane compressor by the introduced gas filled in the shell.

Also, the present invention provides a double-acting type orbiting vane compressor having a high-pressure structure in which discharged gas is filled in a shell. Consequently, the present invention has the effect of preventing the gas from being lost due to heat generated from the drive unit, and therefore, improving the compression efficiency of the orbiting vane compressor.

Also, the present invention provides a double-acting type orbiting vane compressor that is capable of guiding gases discharged from a pair of compression units to an outlet tube in a simple structure. Consequently, the present invention has the effect of enabling the orbiting vane compressor to be easily manufactured and of smoothly discharging the compressed refrigerant gas out of the orbiting vane compressor.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A double-acting type orbiting vane compressor, comprising:

a shell;

an inlet tube through which refrigerant gas enters;

an outlet tube through which refrigerant gas is discharged;

a crankshaft installed inside the shell, rotated by a drive unit and comprising a crank pin eccentrically formed at an upper end of the crankshaft, the crankshaft having an oil supplying channel formed longitudinally therethrough;

an orbiting vane which performs an orbiting movement due to rotation of the crankshaft, comprising a circular vane plate, an upper circular vane formed on a middle of an upper surface of the circular vane plate and protruding upward, a lower circular vane formed on a middle of a lower surface of the circular vane plate, protruding downward and corresponding to the upper circular vane, and a boss formed at a middle of an inner area of the lower circular vane and protruding downward, the boss being configured to receive an upper end of the crank pin;

an upper compression unit in which the upper circular vane is positioned, which compresses the refrigerant gas which enters through the inlet tube due to an orbiting movement of the upper circular vane;

a lower compression unit in which the lower circular vane is positioned, which compresses the refrigerant gas which enters through the inlet tube due to an orbiting movement of the lower circular vane;

a high and low pressure separating plate disposed between an outer circumferential part of an upper cylinder and an inner circumferential part of the shell;

a lower separating plate attached to a lower surface of a lower cylinder such that the lower separating plate surrounds outlet ports of the lower cylinder; and a guide channel which guides high-pressure refrigerant gases discharged through the outlet ports of the lower cylinder to the outlet tube, wherein the inlet tube comprises a single inlet tube which penetrates the shell, the refrigerant gas which enters the inlet tube is introduced into the respective upper and lower cylinders and is guided into the upper and lower compression units through inlet ports formed at the respective upper and lower cylinders, and the refrigerant gas which is compressed by the upper and lower compression units is discharged through outlet ports formed at the respective upper and lower cylinders.

2. The compressor as set forth in claim 1, wherein an opening is provided in a circumferential part of each of the circular vanes, and the orbiting vane further comprises sliders disposed in the openings.

3. The compressor as set forth in claim 2, wherein a through-hole is provided in a circumferential part of each of the circular vanes, adjacent to a corresponding slider, wherein refrigerant gas is introduced into the circular vanes through the through-holes.

4. The compressor as set forth in claim 1, wherein annular spaces are defined between inner rings disposed in the upper and lower cylinders and inner walls of the upper and lower cylinders, respectively.

5. The compressor as set forth in claim 1, wherein inlet ports are formed at predetermined positions of circumferential parts of the upper and lower cylinders, respectively.

6. The compressor as set forth in claim 1, wherein the outlet ports are formed at an upper surface of the upper cylinder and a lower surface of the lower cylinder, respectively.

7. The compressor as set forth in claim 6, wherein each of the outlet ports comprises: inner and outer outlet ports communicating with inner and outer compression chambers divided by the corresponding circular vane disposed in each of the upper and lower cylinders.

8. The compressor as set forth in claim 1, wherein the guide channel comprises a through-pipe extending upward from the lower separating plate through the lower cylinder, the upper cylinder, and the high and low pressure separating plate.

9. The compressor as set forth in claim 1, wherein the guide channel comprises an external guide pipe having one end penetrating the shell from the outside of the shell such that the external guide pipe is inserted between the lower separating plate and the lower surface of the lower cylinder and another end penetrating a predetermined position of an upper circumferential part of the shell.

* * * * *